US010654262B2

(12) United States Patent
Oku et al.

(10) Patent No.: US 10,654,262 B2
(45) Date of Patent: May 19, 2020

(54) PLATE CYLINDER AND PLATE MOUNTING DEVICE

(71) Applicant: SHOWA ALUMINUM CAN CORPORATION, Tokyo (JP)

(72) Inventors: Tomohiro Oku, Tokyo (JP); Toshihiko Onishi, Tokyo (JP); Toru Kitagawa, Tokyo (JP); Hitoshi Tojima, Tokyo (JP)

(73) Assignee: SHOWA ALUMINUM CAN CORPORATION, Tokyo (JP)

( * ) Notice: Subject to any disclaimer, the term of this patent is extended or adjusted under 35 U.S.C. 154(b) by 0 days.

(21) Appl. No.: 15/312,082

(22) PCT Filed: May 12, 2015

(86) PCT No.: PCT/JP2015/063627

§ 371 (c)(1),
(2) Date: Nov. 17, 2016

(87) PCT Pub. No.: WO2016/002348

PCT Pub. Date: Jan. 7, 2016

(65) Prior Publication Data

US 2017/0087820 A1 Mar. 30, 2017

(30) Foreign Application Priority Data

Jun. 30, 2014 (JP) ..... 2014-134702

(51) Int. Cl.
*B41F 27/00* (2006.01)
*B41F 27/06* (2006.01)
(Continued)

(52) U.S. Cl.
CPC ..... *B41F 27/06* (2013.01); *B41F 27/005* (2013.01); *B41F 27/1206* (2013.01); *B41F 27/1231* (2013.01); *B41F 17/22* (2013.01)

(58) Field of Classification Search
CPC ..... B41F 13/10; B41F 27/06; B41F 27/10; B41F 27/14; B41F 27/105; B41F 27/1206; B41F 27/1218; Y10S 101/36
See application file for complete search history.

(56) References Cited

U.S. PATENT DOCUMENTS 1,789,292 A * 1/1931 Banzett ..... B41F 27/105 101/415.1
3,456,587 A * 7/1969 Hulen ..... B41F 27/1231 101/415.1

(Continued)

FOREIGN PATENT DOCUMENTS

CN 102076499 A 5/2011
CN 102112314 A 6/2011

(Continued)

OTHER PUBLICATIONS

International Search Report for PCT/JP2015/063627 dated Jun. 9, 2015.

(Continued)

*Primary Examiner* — Judy Nguyen
*Assistant Examiner* — Marissa Ferguson-Samreth
(74) *Attorney, Agent, or Firm* — Millen, White, Zelano & Branigan, P.C.; William Nixon

(57) ABSTRACT

A stopper for assuredly preventing shifting of a cylindrical printing plate mounted on a plate cylinder is provided. A plate cylinder 1 has a plate-mounting surface 12 on which a cylindrical printing plate 3 is fitted from the front end side and mounted. A front stopper 4 is provided on the end portion of the front end side. The front stopper 4 is configured so as to be able to switch between a protruding orientation in which at least a portion of the stopper is positioned so as to protrude to the outside of the plate-mounting surface 12 in the radial direction and a retracted (Continued)

orientation in which the entire stopper is positioned to the inside of the plate-mounting surface 12 in the radial direction.

14 Claims, 5 Drawing Sheets

(51) Int. Cl.
*B41F 27/12* (2006.01)
*B41F 17/22* (2006.01)

(56) References Cited

U.S. PATENT DOCUMENTS

| | | | | | |
|---|---|---|---|---|---|
| 4,727,806 | A * | 3/1988 | Green, Sr. | B41F 27/005 | 101/415.1 |
| 4,833,986 | A * | 5/1989 | Kobler | B41F 27/1237 | 101/415.1 |
| 5,167,186 | A | 12/1992 | Honkawa et al. | | |
| 5,209,163 | A * | 5/1993 | Banike | B41F 27/005 | 101/378 |
| 5,317,972 | A | 6/1994 | Honkawa et al. | | |
| 5,379,693 | A * | 1/1995 | Hoffmann | B41F 27/005 | 101/216 |
| 8,635,952 | B2 | 1/2014 | Izume | | |
| 8,800,445 | B2 * | 8/2014 | Rogge | B41F 27/005 | 101/383 |
| 8,887,630 | B2 | 11/2014 | Izume | | |
| 9,102,135 | B2 | 8/2015 | Minoshima et al. | | |
| 9,421,754 | B2 | 8/2016 | Izume | | |
| 2007/0231091 | A1 * | 10/2007 | Ohsawa | B41F 27/02 | 408/69 |
| 2011/0061551 | A1 | 3/2011 | Izume | | |
| 2011/0120332 | A1 | 5/2011 | Izume | | |
| 2013/0263750 | A1 * | 10/2013 | Minoshima | B41F 27/1218 | 101/383 |
| 2015/0083007 | A1 | 3/2015 | Izume | | |
| 2018/0037021 | A1 * | 2/2018 | Oku | B41F 13/10 | |

FOREIGN PATENT DOCUMENTS

| | | | | | |
|---|---|---|---|---|---|
| CN | 103153622 | A | | 6/2013 | |
| CN | 103534096 | A | | 1/2014 | |
| DE | 2948488 | | * | 6/1981 | B41F 13/16 |
| DE | 4142876 | A1 | | 7/1992 | |
| DE | 19948878 | A1 | | 4/2001 | |
| EP | 181726 | A2 | * | 5/1986 | B41F 13/10 |
| EP | 1090753 | A2 | | 4/2001 | |
| JP | 2006272682 | A | * | 10/2006 | B41F 17/22 |
| JP | 2010042531 | | * | 2/2010 | B41F 27/06 |
| JP | 4925471 | B2 | | 4/2012 | |
| JP | 201286439 | A | | 5/2012 | |
| WO | 2011077944 | | * | 6/2011 | B41F 13/10 |
| WO | 2011077944 | A1 | | 6/2011 | |

OTHER PUBLICATIONS

English Abstract for JP-2012-086439, Publication Date: Oct. 5, 2012.

English Abstract for WO2011077944, Publication Date: Jun. 30, 2011.

English Abstract for JP4925471, Publication Date: Apr. 25, 2012.

Office Action and Search Report dated Feb. 24, 2018 Corresponding to Chinese Patent Application No. 201580026133.9.

European Search Report dated Jan. 29, 2018 Corresponding to EP 15 81 4657.

* cited by examiner (a)

(b)

(a)

(b)

PLATE CYLINDER AND PLATE MOUNTING DEVICE

FIELD OF THE INVENTION

The present invention relates to a plate cylinder for preventing shifting of a cylindrical printing plate after it is mounted.

TECHNICAL BACKGROUND

Conventionally, it is known that a cylindrically shaped printing plate is configured to be attached to an outer circumferential surface of a cylindrical plate cylinder fixedly provided on a plate drive shaft from the front end of the plate drive shaft.

The plate cylinder described in Patent Document 1 is provided with a circumferential direction positioning groove to which an engaging part of a plate is fitted from the front end side and an axial direction positioning stopper arranged at the rear end of the plate cylinder and configured to be brought into contact with the end portion of the printing plate.

PRIOR ART DOCUMENTS

Patent Document

Patent Document 1: Japanese Patent Publication No. 4925471

SUMMARY OF THE INVENTION

Problems to be Solved by the Invention

However, in a plate cylinder as described in Patent Document 1, since the engaging part of the printing plate is fitted into the circumferential direction positioning groove, there is no concern for the printing plate to move in the circumferential direction. However, since the stopper is provided only on the rear end face of the plate cylinder, there is a concern that shifting of the printing plate may occur toward the front end side even if shifting of the printing plate toward the rear end side of the plate cylinder can be prevented.

Means for Solving the Problems

The present invention was made in view of the aforementioned technical background, and aims to provide a stopper capable of assuredly preventing shifting of a cylindrical printing plate mounted on a plate cylinder.

The present invention has the structure as recited in the following Items [1] to [6].

[1] A plate cylinder including:

a plate-mounting surface on which a cylindrical printing plate is fitted from a front end side and mounted, and a front stopper provided at an end portion of the front end side, wherein the front stopper is configured so as to be able to switch between a protruding orientation in which at least a portion of the stopper is positioned so as to protrude to an outside of the plate-mounting surface in a radial direction and a retracted orientation in which an entire stopper is positioned to an inside of the plate-mounting surface in the radial direction.

[2] The plate cylinder as recited in the aforementioned Item [1], further including:

a plate fixing member provided on the outer circumferential surface of the plate cylinder so as to move radially inward and outward and configured to bring the printing plate in close contact with the plate-mounting surface to fix the printing plate to the plate-mounting surface, wherein the front stopper switches the orientations in conjunction with a radially outward movement of the plate fixing member.

[3] The plate cylinder as recited in the aforementioned Item [2], wherein the front stopper switches the orientations in conjunction with a rotational movement of a rotation shaft configured to movably operate the plate fixing member.

[4] The plate cylinder as recited in any one of the aforementioned Items [1] to [3], wherein the front stopper includes a fixing mechanism configured to fix the protruding orientation.

[5] The plate cylinder as recited in any one of the aforementioned Items [1] to [4], further including an end stopper provided on a base end side opposed to the front end side.

[6] A plate-mounting device equipped with the plate cylinder as recited in any one of the aforementioned Items [1] to [5].

Effects of the Invention

According to the invention as recited in the aforementioned Item [1], since the plate cylinder is equipped with a plate-mounting surface on which a cylindrical printing plate is fitted from a front end side and mounted, and a front stopper is provided at an end portion of the front end side and configured so as to be able to switch between a protruding orientation in which at least a portion of the stopper is positioned so as to protrude to an outside of the plate-mounting surface in the radial direction and a retracted orientation in which the entire stopper is positioned to an inside of the plate-mounting surface in the radial direction, when a printing plate is attached to the plate-mounting surface of the plate cylinder and the front stopper is switched to the protruding orientation, an end portion of the printing plate comes into contact with at least a portion of the front stopper, assuredly preventing the printing plate from shifting toward the front end or falling off.

Further, since the outer diameter of the plate cylinder becomes smaller than the inner diameter of the printing plate by switching the front stopper to the retracted orientation, the printing plate can be easily attached to and removed from the front end side of the plate cylinder.

According to the invention as recited in the aforementioned Item [2], a plate fixing member is provided on the outer circumferential surface of the plate cylinder so as to move radially inward and outward and configured to bring the printing plate in close contact with the plate-mounting surface to fix the printing plate to the plate-mounting surface, and the front stopper switches the orientations in conjunction with the radially outward movement of the plate fixing member. Therefore, shifting of the printing plate toward the front end side or falling off therefrom can be prevented by switching of the orientation of the front stopper in conjunction with the radially outward movement of the plate fixing member with respect to the plate cylinder. Further, shifting or falling of the printing plate can also be assuredly prevented by a pressed state in which the printing plate is pressed by the plate fixing member radially outward of the plate cylinder.

Further, since the operation of preventing the printing plate from shifting toward the front end side or falling off therefrom and the operation to bring the printing plate into close contact with the plate-mounting surface of the plate cylinder of the printing plate can be performed simultaneously in one operation, the operation can be performed easily.

According to the invention as recited in the aforementioned Item [3], since the front stopper switches its orientation in conjunctions with a rotational movement of a rotation shaft configured to movably operate the plate fixing member, it can be configured as a simple structure in which the front stopper and the plate fixing member are provided on the same shaft.

Further, since the protruding orientation and the retracted orientation of the front stopper can be mutually switched with a simple operation of only rotating the front stopper, the operation of attaching and removing the printing plate can be performed easily.

According to the invention as recited in the aforementioned Item [4], since the front stopper is provided with a fixing mechanism which enables fixing of the protruding orientation, there is no concern for unintended switching of orientation during printing as long as the front stopper is fixed in position. Therefore, the printing plate can always be prevented from shifting toward the front end side or slipping off.

According to the invention as recited in the aforementioned Item [5], since an end stopper is provided on a base end side opposed to the front end side, the end portion of the printing plate attached to the outer circumferential surface of the plate cylinder comes into contact with the end stopper, shifting of the printing plate toward the front end side or falling off therefrom can be assuredly prevented.

Since the stoppers are provided on both sides, i.e., the front end side and the rear end side, of the plate cylinder, shifting of the printing plate mounted on the plate cylinder in the axial direction or falling off can be prevented. Further, shifting of the printing plate in the radial direction of the plate cylinder or falling off can also be prevented by a pressed state in which the printing plate is pressed radially outside of the plate cylinder by the plate fixing member.

According to the invention as recited in the aforementioned Item [6], since the plate cylinder as recited in any one of the aforementioned Items [1] to [5] is provided, when the printing plate is attached to the plate-mounting surface of the plate cylinder and the front stopper is switched to the protruding orientation, the end portion of the printing plate comes into contact with at least a portion of the front stopper, which assuredly prevents the printing plate from shifting in the front end side direction or falling off therefrom.

Further, since the outer diameter of the plate cylinder becomes smaller than the inner diameter of the printing plate by switching the front stopper to the retracted orientation, the printing plate can be easily attached to and removed from the front end side of the plate cylinder.

EMBODIMENTS FOR CARRYING OUT THE INVENTION

Hereinafter, some embodiments of the present invention will be described with reference to the drawings.

Figure 1:
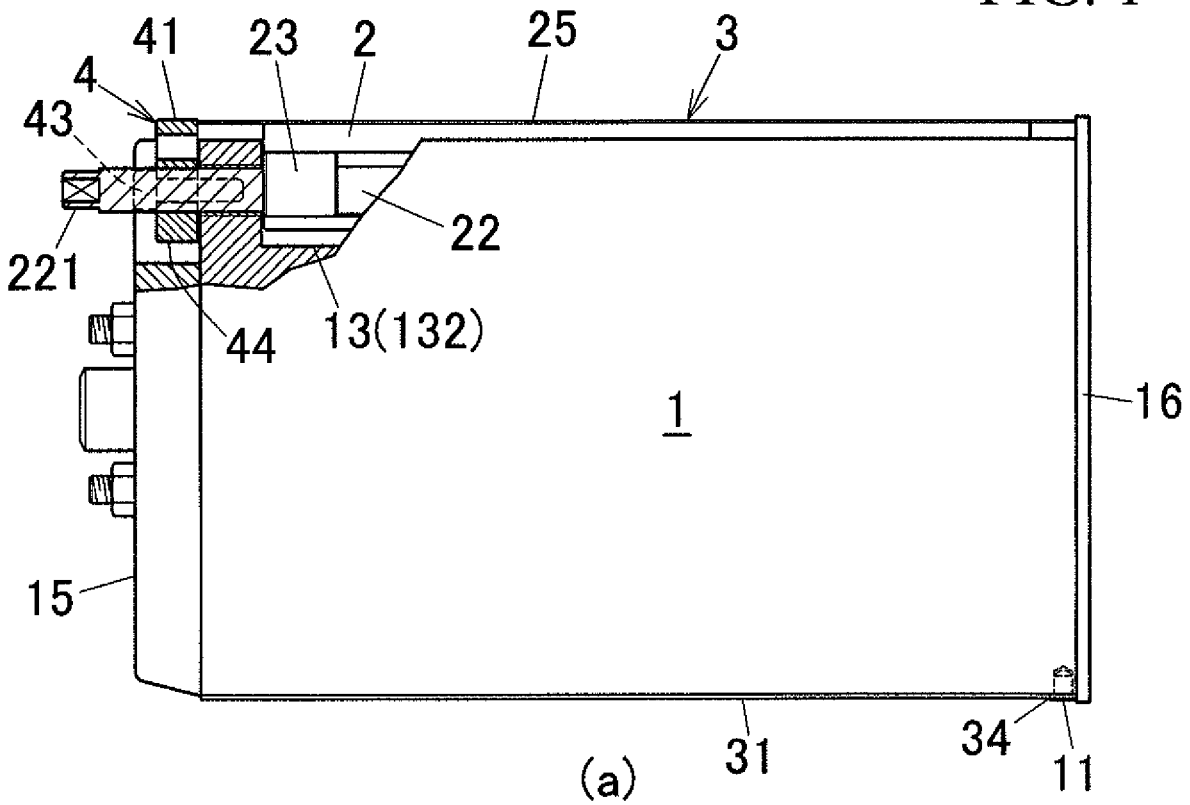
FIG. 1 is an overall view showing a plate cylinder provided with a front stopper according to the present invention.
Figure 1:
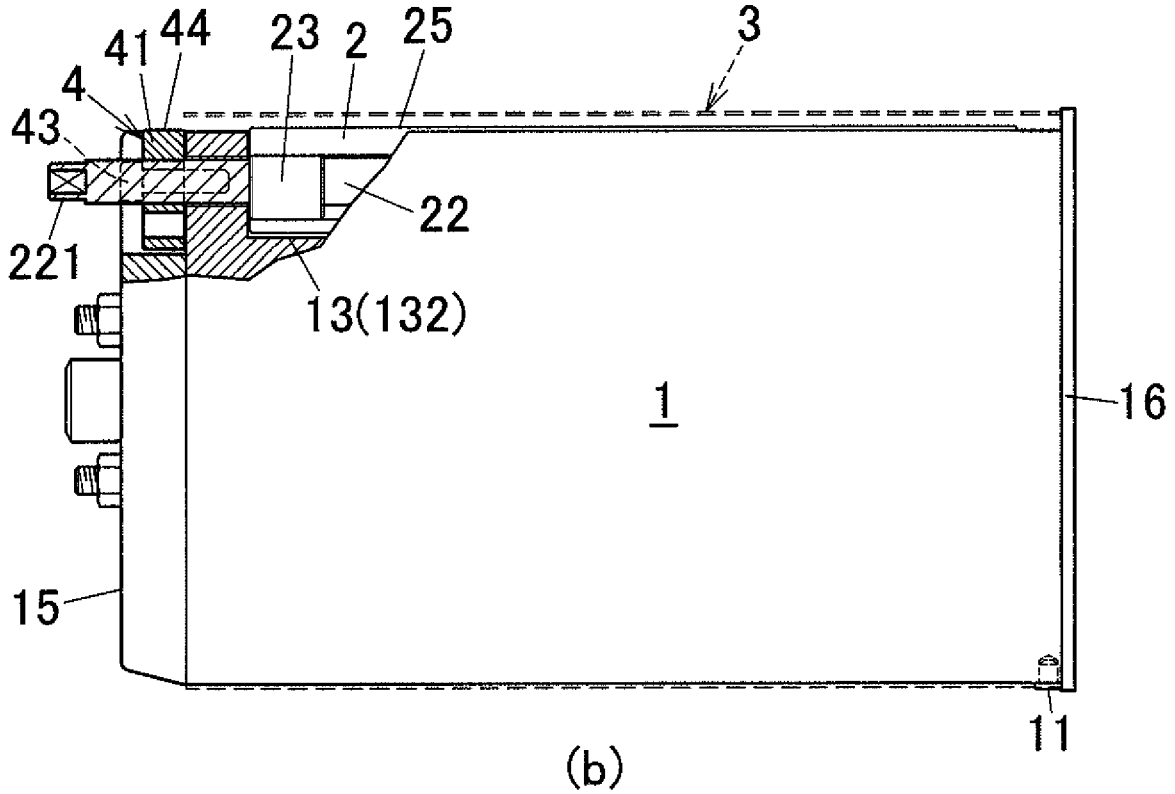
Figure 2:
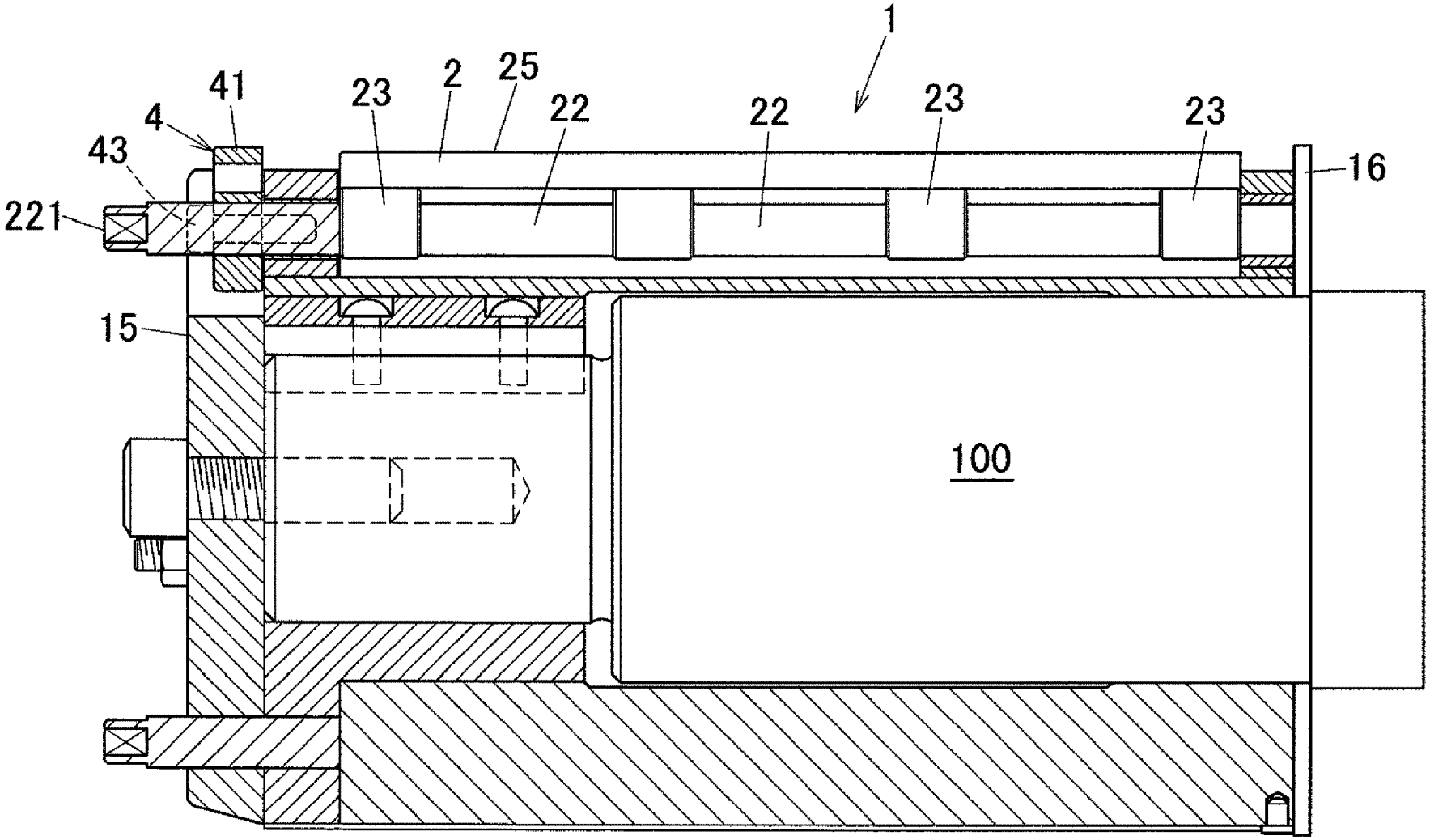
FIG. 2 is a structural cross-sectional view of the plate cylinder for explaining the front stopper according to the present invention.
Figure 3:
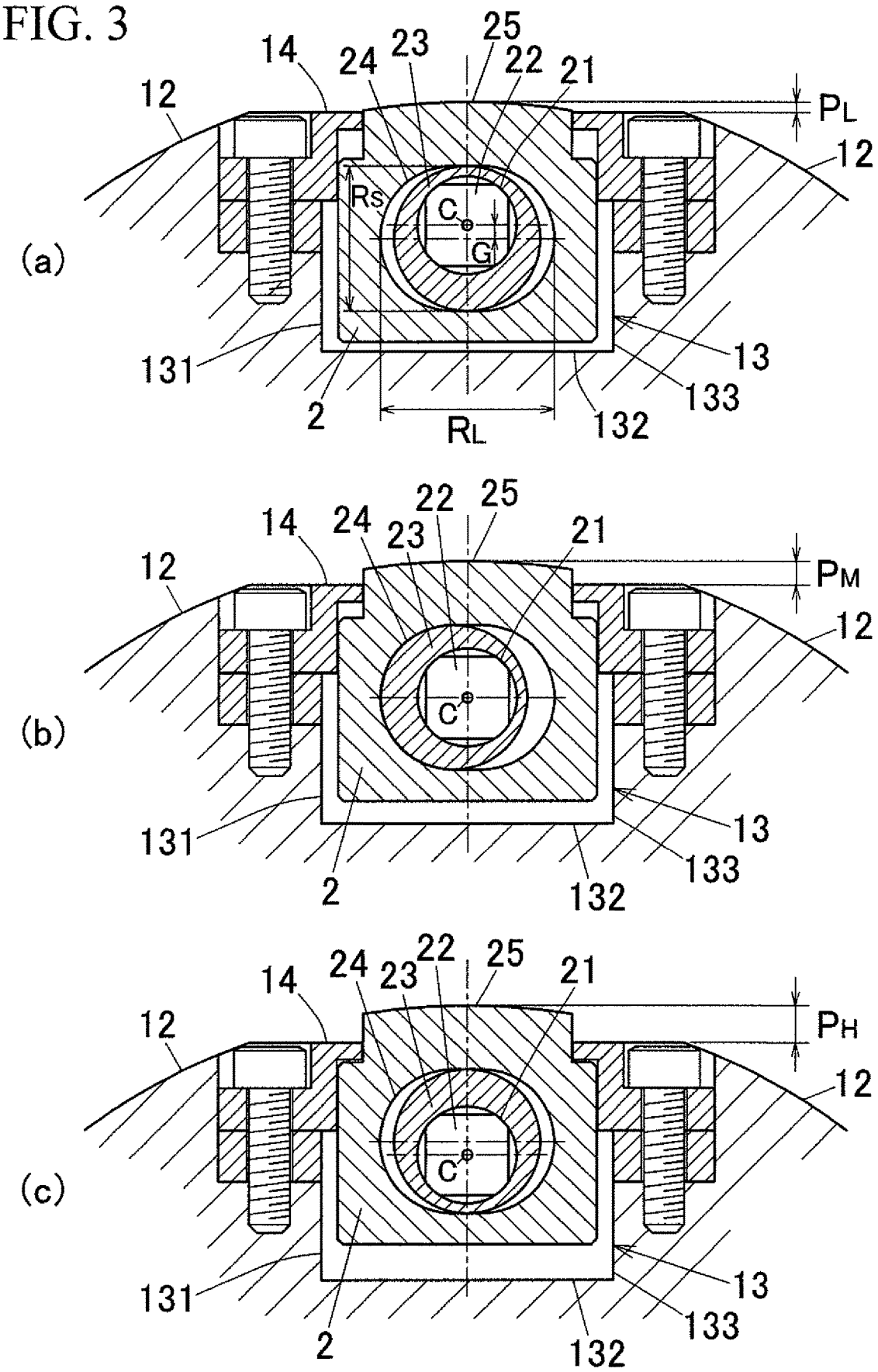
FIG. 3 is a structural explanatory view of a cam mechanism for explaining the front stopper according to the present invention.
Figure 4:
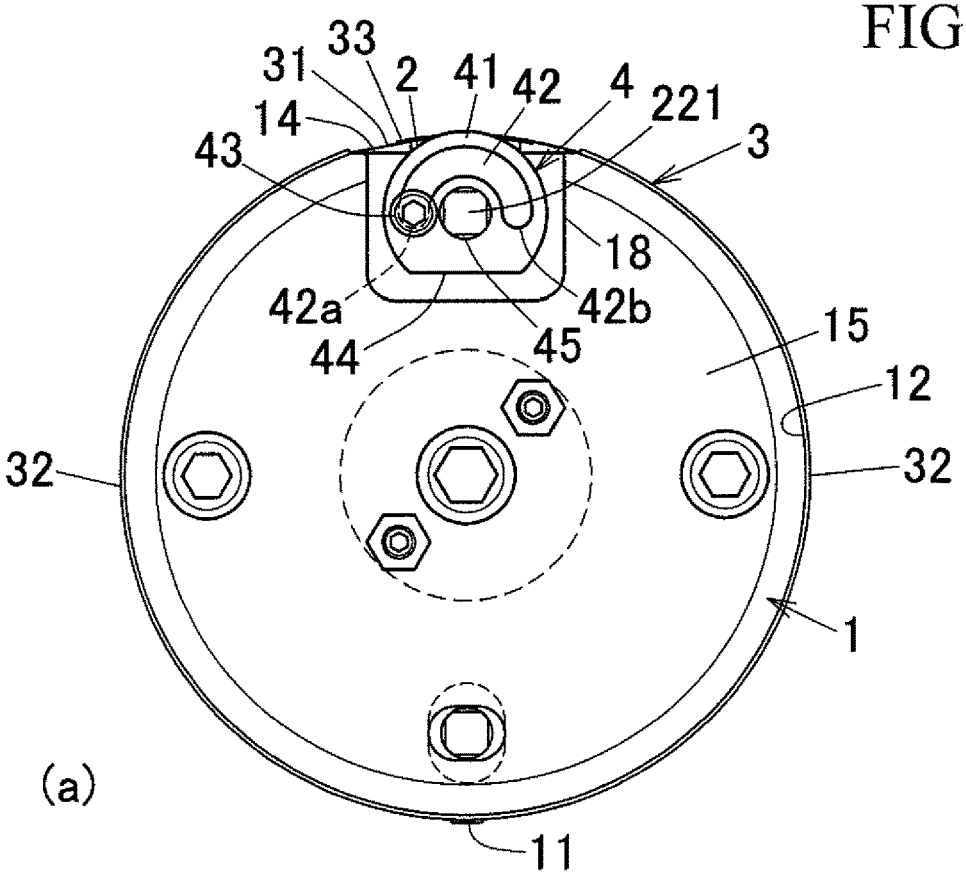
FIG. 4 is an operational explanatory view of the front stopper orientation according to the present invention.
Figure 4:
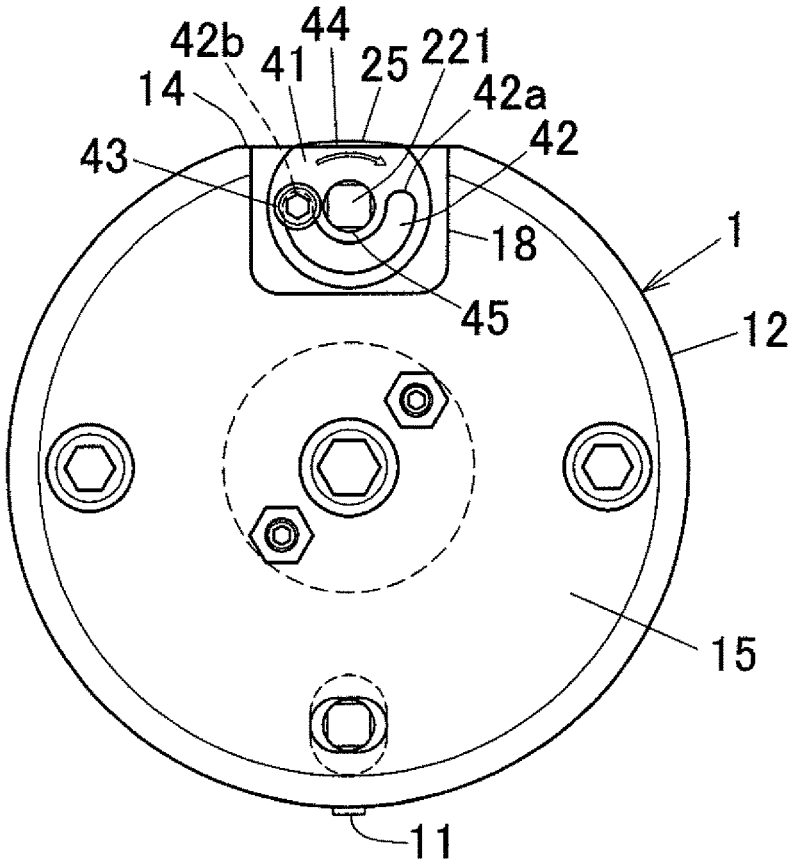
Figure 5:
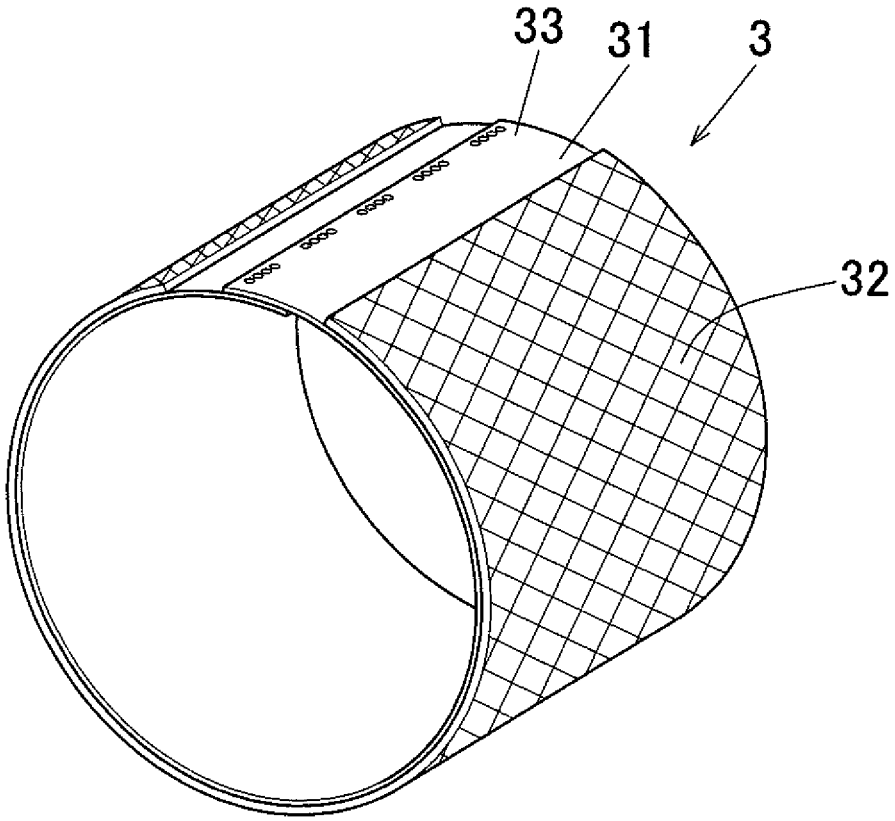
FIG. 5 is a perspective view of a printing plate to be regulated by the front stopper according to the present invention.

FIG. 1 is an overall view showing a plate cylinder 1 provided with a front stopper 4. FIG. 2 is a structural cross-sectional view of the plate cylinder 1 for explaining the front stopper 4. FIG. 3 is a structural explanatory view of a cam mechanism for explaining the front stopper 4. FIG. 4 is an operational explanatory view of the front stopper 4. FIG. 5 is a perspective view of a printing plate 3 to be regulated by the front stopper 4.

First, with reference to FIGS. 1 to 4, a plate mounting device equipped with a plate cylinder 1 provided with a front stopper 4 for assuredly preventing shifting of the cylindrical printing plate 3 mounted on the plate cylinder 1 toward the front end side will be described.

Hereinafter, the up and down direction of the plate cylinder 1 shown in FIG. 1 is referred to as an up and down direction. The left side thereof is referred to as a front face or a front end. The right side is referred to as a rear face or a rear end. The left and right sides as seen from the front face is referred to as left and right, respectively.

A plate mounting device is commonly provided on a print device for printing on a print target and an engraving machine for engraving print patterns on a printing plate 3 used in a print device.

As a printing plate to be mounted on the plate cylinder 1, a printing plate 3 formed into a cylindrical shape, particularly a small-diameter printing plate 3, is used.

A print material to be printed is a beverage metal can. In particular, an aluminum or aluminum alloy closed-end cylindrical beverage metal can produced by drawing and ironing (DI) a flat plate is suitably subjected to printing.

The plate mounting device is equipped with a plate drive shaft 100 provided so as to protrude forward from a machine casing of a print device and a plate cylinder 1 fitted from the front end side of the plate drive shaft 100 to be fixed to the outer circumferential surface of the plate drive shaft 100 (see FIG. 2).

The base end part side of the plate drive shaft 100 is rotatably supported by the machine casing of the print device and rotated at a predetermined speed in a predetermined direction by a well-known drive mechanism.

The plate cylinder 1 is formed into a cylindrical shape and provided with an insertion hole at its center in which the plate drive shaft 100 is inserted.

On the outer circumference of the plate cylinder 1, a cylindrical plate-mounting surface 12 concentric with the plate drive shaft 100 is formed. To the plate-mounting surface 12, a printing plate 3, which will be detailed later, is removably attached.

The inside of the plate cylinder 1 is removed and hollow for weight reduction. The plate cylinder 1 is equipped with a cylinder part in which the plate-mounting surface 12 is formed on the outer circumference thereof and a cover part 15 covering the front face of the plate cylinder 1.

The plate cylinder 1 is fixed to the plate drive shaft 100 in a state in which the plate drive shaft 100 is fitted in the insertion hole, so that the plate cylinder 1 rotates integrally with the plate drive shaft 100.

It is preferable that the plate-mounting surface 12 have a surface roughness of around Ra 1 μm or less to maintain static friction in order to secure a fixing force by frictional resistance with the inner surface of the mounted printing plate 3.

Considering of keeping a small surface roughness and a scratch resistance on the surface, it is preferable that the plate-mounting surface 12 be subjected to hard chromium painting (plating).

The printing plate 3 is equipped with a plate main body 31 formed into a cylindrical shape with an elastic material and a plate part 32 formed on a part of the outer circumferential surface of the plate main body 31 and made of a resin layer (see FIG. 5).

The plate main body 31 is structured by forming an elastic material sheet into a cylindrical shape and joining both ends thereof in an overlapped manner. The plate part 32 is provided at a predetermined position on the outer circumferential surface of the plate main body 31 excluding the joined portion.

The elastic material sheet is made of an appropriate magnetic or nonmagnetic metal rectangular elastic material sheet, etc., and for example, a commercially available tin plate (Fe) can be used. The sheet may have any thickness so long as it allows forming into a cylindrical shape and keeping the cylindrical shape by elasticity. In this embodiment, the thickness is about 0.26 mm.

On one side of the plate main body 31, a resin layer as a plate part 32 is formed. As the material of the resin layer, a resin, such as, e.g., a polyvinyl alcohol based resin, a vinyl ester based resin, and a polyamide based resin, can be used. It is preferable that the resin have, for example, a Shore D hardness of around D20 to 80 after hardening.

For example, when a UV curable resin (ultraviolet curable resin) for a normal offset printing is used, a troublesome cleaning operation by a solvent or high pressure steam required for cleaning other curable resins will not be required, and normally the cleaning operation can be easily performed with water cleaning.

The resin layer may have any thickness as long as it has a thickness required as a print plate part 32. In this embodiment, a layer having a thickness of 0.4 to 0.6 mm is adhered to one surface of the elastic material sheet.

The cylindrically shaped printing plate 3 is mounted to the plate-mounting surface 12 which is an outer circumferential surface of the plate cylinder 1 by being fitted from the front end side of the plate cylinder 1.

The plate part 32 of the printing plate 3 is formed on the outer surface portion of the plate main body 31 which comes into close contact with the plate-mounting surface 12 when the printing plate 3 is mounted on the plate cylinder 1.

In the plate cylinder 1, a plate fixing member mounting surface 14 made by removing a portion of the cylinder part to form a flat surface is provided. A portion of the outer circumferential of the cylinder part excluding the plate fixing member mounting surface 14 functions as the plate-mounting surface 12 to which the printing plate 3 is mounted (see FIG. 4).

On the plate fixing member mounting surface 14, a plate fixing member 2 arranged on the outer circumferential surface of the plate cylinder 1 in a radially outwardly movable manner for fixing the printing plate 3 is provided.

The plate fixing member mounting surface 14 is positioned radially inward of the cylinder surface including the plate-mounting surface 12.

The outer diameter of the plate-mounting surface 12 and the inner diameter of the printing plate 3 are set to have approximately the same measurement.

Since the plate cylinder 1 is provided with the plate fixing member mounting surface 14, the total circumferential length of the plate-mounting surface 12 and the plate fixing member mounting surface 14 is shorter than the circumferential length of the cylinder surface formed by the plate-mounting surface 12 of the plate cylinder 1.

The circumferential length of the inner circumferential surface of the printing plate 3 is set to be slightly larger than the total circumferential length of the plate-mounting surface 12 and the plate fixing member mounting surface 14 of the plate cylinder 1, and also set to be slightly shorter than the circumferential length of the cylinder surface formed by the plate-mounting surface 12 of the plate cylinder 1.

With this, the insertion of the printing plate 3 into the plate cylinder 1 becomes easy, and the portion pressed by the plate fixing member 2 can be prevented from protruding outside the other part in the radial direction.

On the plate fixing member mounting surface 14, over the majority of the plate fixing member mounting surface 14 in the axial direction, a groove 13 of a rectangular shape elongated in the axial direction when viewed from the outside in the radial direction is formed.

The cross-sectional shape of the groove 13 is a square shape, and both walls 131 and 133 and the bottom wall 132 of the groove 13 are each formed into a flat surface (see FIG. 3).

In the groove 13, the plate fixing member 2 is fitted movably in the radial direction of the plate cylinder 1. The plate fixing member 2 is provided with, inside thereof, a rotation shaft 22 extending in the axial direction of the plate cylinder 1.

The plate fixing member 2 is configured such that the position is movable inside the plate cylinder 1 in accordance with the rotation of the rotation shaft 22.

The plate fixing member 2 is formed into a rectangular shape long in the axial direction and fitted in the groove 13 formed on the plate fixing member mounting surface 14 so as to move in the radial direction of the plate cylinder 1.

The plate fixing member 2 is fitted with almost no gap in the circumferential direction and the axial direction with respect to both end walls in the axial direction of the groove 13 of the plate cylinder 1, and moves in the radial direction of the plate cylinder 1 parallel to the surfaces of both side walls 131 and 133 in the circumferential direction and both end walls in the axial direction.

The radially outward end face 25 of the plate fixing member 2 is formed by a cylindrical surface having the same curvature or the same degree of curvature as the plate-mounting surface 12.

Further, it is preferable that the radially outward end face 25 of the plate fixing member 2 be formed by a cylindrical surface having the same curvature or the same degree of curvature as the plate-mounting surface 12, but it may be formed by a flat surface parallel to the plate fixing member mounting surface 14.

The plate fixing member 2 is configured to press a part of the printing plate 3 mounted on the plate cylinder 1 to expand the diameter from the radially inner side toward the radially outer side within a range inside the cylindrical surface formed by the outer surface of the printing plate 3 including the plate part 32.

The plate fixing member 2 is provided with, at its central portion, a cam hole 24 extending in the lengthwise direction of the plate fixing member 2. Inside the cam hole 24, a rotation shaft 22 and an eccentric cam 23 fixed to the outer circumference of the rotation shaft 22 are provided.

In the plate fixing member 2, a cam hole 24 having an elliptical cross-sectional shape is formed so that the long diameter of the ellipse is parallel to the plate fixing member mounting surface 14 in this embodiment.

The cam hole 24 is configured so that a portion of the outer periphery of the eccentric cam 23 comes into contact with at least a part of the inner circumferential wall of the cam hole 24.

The rotation shaft 22 is provided inside the cam hole 24 in a loosely fitted manner and configured to rotate the eccentric cam 23 fixed to the outer periphery of the rotation shaft 22.

The rotation shaft 22 is configured to be rotatable inside the plate fixing member 2 and for example, it is provided so as to extend in the axial direction of the plate cylinder 1 so as to penetrate the cover part 15 on the front face from the rear face side of the plate cylinder 1.

The front end of the rotation shaft 22 is an operation part 221 penetrating the cover part 15 of the front face of the plate cylinder 1 and configured to rotationally operate the rotation shaft 22 (see FIG. 1).

Further, in this embodiment, the rotation shaft 22 is described as a square shape shaft extending in the axial direction of the plate cylinder 1, but the rotation shaft 22 may be formed into a cylinder shape and the shape is not particularly limited.

The eccentric cam 23 is a plate-shaped member formed into a true circular shape and having a reasonable thickness, and provided with a shaft hole 21 penetrating at a position slightly shifted from the central position of the eccentric cam 23 in the thickness direction (see FIG. 3).

The rotation shaft 22 is inserted into the shaft hole 21 and a plurality of eccentric cams 23 are attached to the outer periphery of the rotation shaft 22 at predetermined intervals in a fixed manner and are configured to rotate in conjunction with the rotation of the rotation shaft 22 (see FIG. 2).

Since the rotation shaft 22 is attached at a position slightly shifted from the central position of the eccentric cam 23, an arbitrary point on the outer periphery of the eccentric cam 23 moves on the elliptical circumference of the cam hole 24 in accordance with the rotation of the rotation shaft 22.

Specifically, in this embodiment, it can be understood that a point on the outer periphery of the eccentric cam 23 positioned on the dashed line shown in FIG. 3(*a*) has moved along at least a portion of the circumference of the cam hole 24 before reaching the position shown in FIG. 3(*c*).

FIG. 3(*a*) shows a case in which the plate fixing member 2 is positioned most radially inside of the plate cylinder 1. FIG. 3(*c*) shows a case in which the plate fixing member 2 is positioned most radially outside of the plate cylinder 1.

The central position of the eccentric cam 23 is set so that, in FIG. 3(*a*) in which the plate fixing member 2 is positioned at the lowermost position, a maximum shifting width of G can occur in the height direction from the center C of the rotation shaft 22, and in FIG. 3(*c*) in which the plate fixing member 2 is positioned at the uppermost position, the central position of the eccentric cam 23 is set so that a maximum shifting width of G can occur in the height direction from the center C of the rotation shaft 22.

Since the position of the rotational center C of the rotation shaft does not change, the height position of the radially outer end face 25 of the plate fixing member 2 changes by a maximum shifting width of 2G in accordance with the rotation of the eccentric cam 23.

In this way, the plate fixing member 2 moves parallel to and in the radial direction of both end walls of the groove 13 in the axial direction in conjunction with the rotation of the eccentric cam 23.

Comparing the minimum position width $P_L$ and the maximum position width $P_H$ between the plate fixing member mounting surface 14 and the end face 25 of the plate fixing member 2 in a case of FIG. 3(*a*) in which the plate fixing member 2 is positioned most inside of the plate cylinder 1 in the radial direction, it can be understood that the maximum position width $P_H$ has changed radially outward by the amount twice the shifting width G between the rotation center C of the rotation shaft 22 and the central position of the eccentric cam 23.

When there is no need to press the printing plate 3 with the plate fixing member 2, the plate fixing member 2 can be maintained at a radially inner side position of the plate-mounting surface 12.

On the outer peripheral part of the rear end face of the cylinder part of the plate cylinder 1, an end stopper 16 for determining the mounting position of the printing plate 3 in the axial direction is fixed (see FIG. 1).

The end stopper 16 is formed into an annular shape protruding to the outside of the plate-mounting surface 12 in the radial direction.

The end stopper 16 is configured so that, when the printing plate 3 is fitted from the front end side of the plate cylinder 1, the rear end side of the printing plate 3 comes into contact.

Since the end stopper 16 is provided, the rear end of the printing plate 3 can be accurately and easily set to the predetermined position.

Since the end stopper 16 is provided at the base end side opposed to the front end side, the end portion of the printing plate 3 attached to the outer circumferential surface of the print cylinder 1 comes into contact with the end stopper 16, assuredly preventing the printing plate 3 from shifting toward the rear end side or falling off therefrom.

Since the stoppers 4 and 16 are provided at both ends, i.e., the front end and the rear end, of the print cylinder 1, shifting of the printing plate 3 mounted on the print cylinder 1 in the radial direction or falling off can be prevented. Further, shifting of the printing plate 3 in the axial direction of the print cylinder 1 or falling off can also be prevented by a pressed state in which the printing plate 3 is pressed radially outward of the print cylinder 1 by the plate fixing member 2.

A circumferential direction positioning protrusion 11 for positioning the printing plate 3 in the circumferential direction is provided at the bottom of the plate cylinder 1 and the front side of the end stopper 16.

The circumferential direction positioning protrusion 11 is, for example, formed into a circular shape in plan view as a step part protruding slightly radially outward of the plate cylinder 1.

In the printing plate 3, a fitting part 34 to be fitted to the circumferential direction positioning protrusion 11 of the plate cylinder 1 is provided at one end portion of the side opposed to the joined part 33 (lower right side of FIG. 1(*a*) on the paper).

The fitting part 34 is provided with a notch extending in the axial direction of the printing plate 3, and an arc matching the outer peripheral shape of the circumferential direction positioning protrusion 11 at the end portion.

When the printing plate 3 is mounted to the rear end side of the plate cylinder 1, the position of the printing plate 3 in the circumferential direction can be determined since the arc shape surface of the fitting part 34 of the printing plate 3 comes into contact with the outer circumferential surface of the circumferential direction positioning protrusion 11.

A front stopper 4 is provided on the opposite side of the rear end of the plate cylinder 1 in which the end stopper 16 is provided. That is, the front stopper 4 is provided at the upper part on the front end side of the plate cylinder 1.

The front stopper 4 is provided with a stopper main body 41 fixed to the front end side of the rotation shaft 22 provided in the cam hole 24. An operation permissible hole 42, which is a hole penetrating in the thickness direction, is formed in the stopper main body 41.

The stopper main body 41 is formed by a plate-shaped member having an appropriate thickness, and as shown in FIGS. 4(*a*) and 4(*b*), for example, it is formed into a shape in which a portion of the outer periphery of a circle is cut out in a front view.

In this embodiment, the stopper main body 41 is arranged at a concave part formed by removing a part of the cover part 15 of the front surface of the plate cylinder 1.

At the central part of the stopper main body 41, a circular hole 45 is formed, and in the circular hole 45, the rotation shaft 22 is inserted and the stopper main body 41 is attached in a fixed manner.

The stopper main body 41 is configured so as to rotate in conjunction with the rotation of the rotation shaft 22, and the front end of the rotation shaft 22 protruding to the front end side of the stopper main body 41 is configured as an operation part 221 to be operated by being, e.g., pinched at the time of the rotation operation (see FIG. 1).

Further, the portion shown by x at the front end portion of the operation part 221 is a groove formed by hollowing out the inside.

The operation permissible hole 42 is provided on the outer periphery of the rotation shaft 22 as viewed from the front face side of the stopper main body 41 and formed as an elongated hole along a portion of the outer periphery of the stopper main body 41.

The operation permissible hole 42, in this embodiment, is arranged at a position opposed to the notch part 44 of the stopper main body 41 (see FIG. 4).

In the operation permissible hole 42, a regulating member 43, such as a lock bolt and a cap screw in which one end is fixed to the plate cylinder 1, is loosely fitted, and the other end of the regulating member 43 is provided so as to protrude forwardly of the stopper main body 41.

The rotation of the stopper main body 41 is regulated by the operation permissible hole 42 and the regulating member 43 loosely fitted in the operation permissible hole 42, and in this embodiment, the stopper main body 41 is configured so as to be rotatable in a range of about 180 degrees.

The stopper main body 41 regulates the rotation of the stopper main body 41, for example, by rotating the stopper main body 41 left and right to bring one end portion 42*a* of the operation permissible hole 42 into a state in which it is in contact with the regulating member 43 as shown in FIG. 4(*a*) and to bring the other end portion 42*b* of the operation permissible hole 42 into a state in which it is in contact with the regulating member 43 as shown in FIG. 4(*b*).

In the state of FIG. 4(*b*), the stopper main body 41 is provided so that the distance from the rotational center of the stopper main body 41 to the notch part 44 and the distance from the rotational center of the stopper main body 41 to the plate fixing member mounting surface 14 of the plate cylinder 1 are the same.

Since the front stopper 4 is configured such that the notch part 44 having a shape formed by cutting a portion of the outer periphery is provided, when the front stopper 4 is set to the protruding orientation by being rotated in a state in which the printing plate 3 is mounted to the plate cylinder 1 so that the notch part 44 is positioned at the bottom part, the printing plate 3 can be prevented from falling from the front end side of the plate cylinder 1 by shifting toward the front face side.

Also, by rotating the front stopper 4 to set in the retracted orientation in which the notch part 44 is positioned at the upper part, the printing plate 3 can be attached and removed from the front end side of the plate cylinder 1.

In this way, the rotation range of the stopper main body 41 can be regulated by the configuration that the regulating member 43 is loosely fitted in the operation permissible hole 42.

According to the behavior of the front stopper 4 in conjunction with the rotation of the rotation shaft 22, the stopper main body 41 is configured so that it can be switched between the protruding orientation in which at least a portion is positioned so as to protrude to the outside of the outer diameter of the plate cylinder 1 and the retracted orientation in which the entire stopper is positioned so as to not protrude to the outside of the outer diameter of the plate cylinder 1.

As described above, since the front stopper 4 switches its orientation in conjunction with the rotation of the rotation shaft 22 for movably operating the plate fixing member 2, it can be configured as a simple structure in which the front stopper 4 and the plate fixing member 2 are provided on the same shaft.

Further, since the protruding orientation and the retracted orientation of the front stopper 4 can be mutually switched with a simple operation of only rotating the front stopper 4, the operation of attaching and removing the printing plate 3 can be performed easily.

The regulating member 43 is configured so as to be able to function as a fixing mechanism to fix the orientation of the stopper main body 41 by tightening a nut, etc., provided at the head of the regulating member 43.

For example, by tightening the nut of the regulating member 43 in a state in which the stopper main body 41 is in the protruding orientation, the stopper main body 41 can be fixed in its orientation as it is.

Similarly, the stopper main body 41 can be fixed in the retracted orientation as it is, or in an orientation other than the protruding orientation and the retracted orientation that is desired by a user.

Since the front stopper 4 is provided with the fixing mechanism 43 which enables to fix the protruding orientation, there is no concern for unintended switching of the orientation during printing by fixing the position of the front stopper 4. Therefore, shifting of the printing plate 3 toward the front end side or falling off therefrom can always be prevented.

Hereinafter, the method of attaching and detaching the printing plate 3 to and from the plate cylinder 1 equipped with the front stopper 4 and the plate fixing member 2 will be described.

In the printing plate mounting step for attaching the printing plate 3 to the plate mounting device, the front stopper 4 is rotated to bring the stopper main body 41 into the retracted orientation, and the plate fixing member 2 is positioned radially inward to bring the printing plate 3 in a state in which it is not pressed radially outward.

The printing plate 3 is fitted from the front end side of the plate cylinder and pressed toward the rear end side so that the fitting part 34 of the printing plate 3 fits into the circumferential direction positioning protrusion 11 of the plate cylinder 1.

The fitting part 34 of the printing plate 3 engages with the circumferential direction positioning protrusion 11 of the plate cylinder 1, and the rear end of the printing plate 3 comes into contact with the end stopper 16 of the plate cylinder 1. Therefore, the pressing of the printing plate 3 further toward the rear side is regulated (see FIG. 1).

With this, the printing plate 3 can be accurately and easily attached to a predetermined position of the plate cylinder 1.

Further, since the circumferential length of the inner circumferential surface of the printing plate 3 is set to be slightly larger than the circumferential length of the outer circumferential surface of the plate cylinder 1, by bending the printing plate 3 according to the shape of the plate cylinder 1, a gap is formed between the plate-mounting surface 12 and the printing plate 3. Therefore, the printing plate 3 can be easily attached to the plate cylinder 1.

When the printing plate 3 is mounted to the plate cylinder 1, the front stopper 4 provided at the front end side of the plate cylinder 1 is rotated so that the front stopper is set to the protruding orientation (see FIG. 4).

The front stopper 4 switches to the protruding orientation in which at least a portion of the front stopper 4 is positioned outside the plate fixing member mounting surface 14 in the radial direction by slightly rotating it from the retracted orientation, and regulates the printing plate 3 from moving to the front end side.

In a state in which a portion of the front stopper 4 is slightly positioned outside the plate fixing member mounting surface 14 in the radial direction, the position of the end face 25 of the plate fixing member 2 is only slightly raised, and the height position of the plate fixing member 2 can be adjusted in a state in which the movement of the printing plate 3 in the axial direction is regulated. Therefore, the printing plate 3 will not shift during the moving operation of the plate fixing member 2.

When the front stopper 4 is in the retracted orientation, the plate fixing member 2 is positioned at the lowermost position. When the front stopper 4 is switched to the protruding orientation in accordance with the rotation of the rotation shaft 22, the plate fixing member 2 gradually rises as the amount of protrusion of the front stopper main body 41 to the outside of the plate fixing member mounting surface 14 increases. When the amount of protrusion of the front stopper main body 41 reaches its maximum amount, the plate fixing member 2 is positioned at the uppermost position.

Since the eccentric cam 23 provided at the outer periphery of the rotation shaft 22, which is the rotation center of the front stopper 4, rotates simultaneously as the front stopper 4 rotates, the plate fixing member 2 moves radially outside and the end face 25 of the plate fixing member 2 comes into contact with the inner circumferential surface of the joined part 33 of the printing plate 3 attached to the plate-mounting surface 12 of the plate cylinder 1.

When the end face 25 of the plate fixing member 2 is moved radially outside until it is equal to the height position of the plate-mounting surface 12 by further rotating the rotation shaft 22, a predetermined tension is applied to the printing plate 3 and the printing plate 3 is brought into close contact with and fixed to the plate-mounting surface 12.

Specifically describing based on FIGS. 3(*a*) to 3(*c*), the inner circumferential wall of the cam hole 24 is pressed upwards at a portion of the outer periphery of the eccentric cam 23 when the eccentric cam 23 having the rotation shaft 22 as its axis rotates in conjunction with the rotation of the rotation shaft 22, which in turn moves the plate fixing member 2 radially outward of the plate cylinder 1 (upward on the paper).

On the other hand, the plate fixing member 2 is configured to move radially inward of the plate cylinder 1 (downward on the paper) when the rotation shaft 22 is rotated to press the inner circumferential wall of the cam hole 24 downward at a portion on the outer periphery of the eccentric cam 23.

When the plate fixing member 2 moves most radially inward of the plate cylinder 1, the end face 25 of the plate fixing member 2 is positioned more inward of the plate-mounting surface 12 of the plate cylinder 1.

At this time, the height position of the end face 25 of the plate fixing member 2 is set so that only the difference between the height position and the minimum position width $P_L$ of the plate fixing member mounting surface 14 occurs.

Further, when the plate fixing member 2 moves most radially outward of the plate cylinder 1, the radially outward end face 25 of the plate fixing member 2 is set radially outward of the plate cylinder 1 by the amount of the maximum position width $P_H$ from the plate fixing member mounting surface 14.

When the printing plate 3 is fixed to the plate cylinder 1, the height position of the outer circumferential surface (radial direction position) of the joined part 33 of the printing plate 3 pressed out in the enlarged diameter direction by the plate fixing member 2 is positioned inside of the cylinder surface formed by the outer surface of the plate part 32 of the printing plate 3 since the end face 25 of the plate fixing member 2 does not protrude outside the plate-mounting surface 12 of the plate cylinder 1.

With this, a portion of the printing plate 3 which was pressed radially outward by the plate fixing member 2 and enlarged protrudes outside the cylinder face formed by the outer surface including the plate part 32 of the printing plate 3, so that a situation in which print ink, etc., adheres to the portion and becomes a cause of a printing blot can be prevented.

Further, the portion of the printing plate 3 pressed out by the plate fixing member 2 is the joined part 33 in which both end portions of the sheet are overlapped, and it is a non-plate part in which a plate part 32 is not formed. Therefore, the plate part 32 is not pressed radially outward, so that the deformation of the plate part 32 can be suppressed and the deterioration of the print quality can be prevented.

In the print step in which print patterns are printed on a print object by a print device, the plate cylinder 1 is rotated in a state in which the printing plate 3 is fixed to the plate cylinder 1 as described above. At this time, since the printing plate 3 is brought into contact and fixed to the plate-mounting surface 12 by the plate fixing member 2, the position of the printing plate 3 does not shift.

When removing the printing plate 3 mounted on the plate cylinder 1, the rotation shaft 22 is rotated so that the front stopper 4 takes the retracted orientation, the notch part 44 of the front stopper 4 is positioned at the upper side, and the plate fixing member 2 is moved in the press releasing direction and fixed in the retracted position.

With this, a gap is formed between the plate-mounting surface 12 and the plate fixing member 2 and the printing plate 3. Therefore, by moving the printing plate 3 in the axial direction, the printing plate 3 can be easily removed from one end of the plate cylinder 1.

As described above, the plate fixing member 2 is provided movably radially inward and outward of the outer circumferential surface of the print cylinder 1 and is configured to bring the printing plate 3 in close contact with and fix the printing plate 3 to the plate-mounting surface 12, and the front stopper 4 switches its orientation in conjunction with the radially outward movement of the plate fixing member 2. Therefore, the orientation of the front stopper 4 can be switched in conjunction of the movement of the plate fixing member 2 to the outside of the print cylinder 1 in the radial direction. As a result, shifting of the printing plate 3 toward the front end side and falling off can be prevented. Further, by pressing the printing plate 3 radially outward of the print cylinder 1 by the plate fixing member 2, shifting of the printing plate 3 and falling off can be assuredly prevented.

Further, since the operation of preventing the printing plate 3 from shifting toward the front end side or falling off and the operation to bring the printing plate 3 into close contact with the plate-mounting surface 12 of the print cylinder 1 of the printing plate can be performed simultaneously in one operation. Therefore, the operation can be performed easily.

The overall configuration and the configuration of each part of the plate mounting device and the printing plate 3 are not limited to the configuration described above and can be arbitrarily changed.

For example, a cylinder material having no seam (joined part 33) can be used as the printing plate 3.

The rotation shaft 22 is configured to be rotated by hand in the aforementioned description, but it can also be rotated by a power such as electricity.

The aforementioned front stopper 4 is made of a plate-shaped member in which a portion of the circumference is cut out, but for example, it can be configured such that the eccentric cam 23 is provided inside the front stopper 4 such as in the aforementioned plate fixing member 2, so that the eccentric cam 23 rotates and the front stopper 4 is pressed to the outside in the radial direction from the inside in the radial direction to switch into the protruding orientation, and that the eccentric cam 23 rotates and the front stopper 4 is pressed to the inside in the radial direction from the outside in the radial direction to switch to the retracted orientation.

Further, for example, it can be configured such that the front stopper 4 itself is constituted by an eccentric member and configured to switch between the protruding orientation and the retracted orientation by rotating it.

In the aforementioned description, the rotation of the front stopper 4 was explained to be regulated by the operation permissible hole 42 in a range of 180 degrees, but it is not limited to that. It can be configured to be rotated in a smaller range or rotated in a larger range, and also it can be configured such that the regulating part is not provided.

It is preferable that the aforementioned front stopper 4 and the plate fixing member 2 be operated by a rotating operation, but not limited to that. It can be configured such that the front stopper 4 and the plate fixing member 2 are moved to the outside in the radial direction from the inside in the radial direction by another operation such as an operation to press up the rotation shaft 22.

Further, it is preferable that the front stopper 4 be configured to operate in conjunction with the plate fixing member 2, but not limited to that. The front stopper 4 and the plate fixing member 2 can be configured such that they are operated by separate operations.

Further, in the aforementioned description, it was explained that the plate fixing member 2 is pushed to the outside in the radial direction from the inside in the radial direction, but for example, it can be configured such that the plate fixing member 2 itself can be constituted by an eccentric member, and the printing plate 3 can be pressed to the outside in the radial direction from the inside in the radial direction by rotating it.

As described above, the front stopper 4 is the print cylinder 1 equipped with the plate-mounting surface 12 on which a cylindrical printing plate 3 is fitted and mounted from a front end side and the front stopper 4 is provided at an end portion of the front end side, and configured so as to be able to switch between a protruding orientation in which at least a portion of the stopper is positioned so as to protrude to the outside of the plate-mounting surface 12 in the radial direction and a retracted orientation in which the entire stopper is positioned to the inside of the plate-mounting surface 12 in the radial direction. Therefore, when the printing plate 3 is attached to the plate-mounting surface 12 of the print cylinder 1 and the front stopper 4 is switched to the protruding orientation, an end portion of the printing plate 3 comes into contact with at least a portion of the front stopper 4, which assuredly prevents the printing plate 3 from shifting to the front end or falling off.

Further, since the outer diameter of the print cylinder 1 becomes smaller than the inner diameter of the printing plate 3 by switching the front stopper 4 to the retracted orientation, the printing plate 3 can be easily attached to and removed from the front end of the print cylinder.

It is apparent that the same effects can be obtained from a plate cylinder 1, a plate mounting device, a printer, and an engraving machine equipped with the plate cylinder 1 described above.

The embodiment described above is only one example of the present invention, and the specific configuration, etc., can be arbitrarily changed in a range in which the functions and the effects of the present invention can be exerted.

The present invention claims priority to Japanese Patent Application No. 2014-134702 filed on Jun. 30, 2014, the entire disclosure of which is incorporated herein by reference in its entirety.

The terms and descriptions used herein are used only for explanatory purposes and the present invention is not limited to them. The present invention allows various design-changes falling within the claimed scope of the present invention unless it deviates from the spirits of the invention.

INDUSTRIAL APPLICABILITY

The present invention can be applied to a stopper for preventing shifting of a printing plate mounted on a print cylinder 1.

DESCRIPTION OF THE REFERENCE NUMERALS

1 . . . plate cylinder
2 . . . plate fixing member
3 . . . printing plate
4 . . . front stopper
12 . . . plate-mounting surface
22 . . . rotation shaft
41 . . . stopper main body
43 . . . fixing mechanism (regulating member)

The invention claimed is:

1. A plate cylinder comprising:

a cylindrical plate-mounting surface on which a cylindrical printing plate is capable of being fitted from a front end side and mounted, a plate fixing member mounting surface having a flat surface arranged on an outer circumferential surface of the plate cylinder and bordered by the cylindrical plate-mounting surface, and a front stopper provided at an end portion of the front end side, wherein the front stopper includes a stopper main body and an operation permissible hole, wherein the front stopper is configured using the operation permissible hole to regulate a rotation of the stopper main body to switch the front stopper between a protruding orientation in which at least a portion of the stopper is positioned so as to protrude to an outside of the plate fixing member mounting surface in a radial direction and to come into contact with a circular plane surface end portion of the fitted cylindrical printing plate, and a retracted orientation in which an entire stopper is positioned to an inside of the plate fixing member mounting surface in the radial direction.

2. The plate cylinder as recited in claim 1, further comprising:

a plate fixing member provided in the plate fixing member mounting surface on the outer circumferential surface of the plate cylinder so as to move radially inward and outward and configured to contact with an inner surface of the printing plate and to bring the printing plate in close contact with the plate-mounting surface to fix the printing plate to the plate-mounting surface, wherein the front stopper switches the orientations in conjunction with a radially outward movement of the plate fixing member.

3. The plate cylinder as recited in claim 2, wherein the front stopper switches the orientations in conjunction with a rotational movement of a rotation shaft configured to movably operate the plate fixing member.

4. The plate cylinder as recited in claim 2, wherein the front stopper and the plate fixing member are separated from each other.

5. The plate cylinder as recited in claim 1, wherein the front stopper includes a fixing mechanism configured to fix the protruding orientation.

6. The plate cylinder as recited in claim 1, further comprising:

an end stopper provided on a base end side opposite to the front stopper.

7. A plate-mounting device equipped with the plate cylinder as recited in claim 1.

8. The plate cylinder as recited in claim 1, wherein the operation permissible hole is formed to fit a regulating member.

9. The plate cylinder as recited in claim 8, wherein the regulating member is in contact with a first end portion of the operation permissible hole in the protruding orientation and in contact with a second end portion of the operation permissible hole in the retracted orientation.

10. The plate cylinder as recited in claim 7, wherein the stopper main body includes a circular hole formed in a central part thereof.

11. The plate cylinder as recited in claim 7, wherein the stopper main body includes a notch part.

12. The plate cylinder as recited in claim 11, wherein the notch part is located opposite the operation permissible hole.

13. The plate cylinder as recited in claim 1, wherein the operation permissible hole regulates the rotation of the main stopper in a range of 180 degrees.

14. The plate cylinder as recited in claim 1, wherein the operation permissible hole penetrates the front stopper in a thickness direction.

* * * * *